US008201900B2

(12) United States Patent
Backhaus et al.

(10) Patent No.: US 8,201,900 B2
(45) Date of Patent: Jun. 19, 2012

(54) SAFETY CABINET

(75) Inventors: Frank Backhaus, Herford (DE); Franz-Josef Hagen, Paderborn (DE)

(73) Assignee: Dueperthal Sicherheitstechnik GmbH & Co. KG, Kleinostheim (DE)

( * ) Notice: Subject to any disclaimer, the term of this patent is extended or adjusted under 35 U.S.C. 154(b) by 0 days.

(21) Appl. No.: 12/719,973

(22) Filed: Mar. 9, 2010

(65) Prior Publication Data

US 2010/0253191 A1 Oct. 7, 2010

(30) Foreign Application Priority Data

Apr. 4, 2009 (DE) ..... 20 2009 004 710 u
Jun. 23, 2009 (EP) ..... 09008198

(51) Int. Cl.
*A47B 88/00* (2006.01)
*A47B 77/10* (2006.01)

(52) U.S. Cl. ..... 312/274; 312/311; 312/324

(58) Field of Classification Search ..... 312/273–274, 312/310–311, 325, 334.2, 334.3, 295, 270.3, 312/8.5, 8.7, 127, 130, 209, 119, 324, 326
See application file for complete search history.

(56) References Cited

U.S. PATENT DOCUMENTS

| | | | | | |
|---|---|---|---|---|---|
| 355,180 | A * | 12/1886 | Kuehnle | 126/340 |
| 1,289,758 | A * | 12/1918 | Heinig | 312/127 |
| 1,345,692 | A * | 7/1920 | Providenti | 312/8.7 |
| 2,361,525 | A * | 10/1944 | Ball et al. | 312/274 |
| 2,465,555 | A * | 3/1949 | Smith | 312/275 |
| 2,473,467 | A * | 6/1949 | Burt | 126/340 |
| 2,583,859 | A * | 1/1952 | Leszak et al. | 312/274 |
| 2,837,395 | A * | 6/1958 | Carani | 312/274 |
| 2,899,255 | A * | 8/1959 | Evans | 312/274 |
| 3,184,276 | A * | 5/1965 | Billups | 312/274 |
| 3,290,719 | A * | 12/1966 | Courson | 16/231 |
| 5,474,374 | A * | 12/1995 | Sandvig | 312/274 |
| 5,944,399 | A * | 8/1999 | Gillispie | 312/324 |
| 6,340,214 | B1 * | 1/2002 | Adams | 312/246 |
| 6,729,701 | B2 * | 5/2004 | Carter et al. | 312/222 |
| 2003/0234600 | A1 * | 12/2003 | Helver | 312/270.3 |
| 2004/0066122 | A1 * | 4/2004 | Holmes | 312/311 |
| 2007/0182295 | A1 * | 8/2007 | Kim et al. | 312/402 |
| 2009/0193836 | A1 * | 8/2009 | Ertz et al. | 62/449 |

FOREIGN PATENT DOCUMENTS

| | | |
|---|---|---|
| DE | 849185 | 9/1952 |
| DE | 202004004855 | 9/2004 |
| DE | 10305444 | 11/2004 |
| DE | 202006007632 | 8/2006 |
| GB | 725757 | 3/1955 |
| WO | WO-9220259 | 11/1992 |

* cited by examiner

*Primary Examiner* — James O Hansen
*Assistant Examiner* — Sasha T Varghese
(74) *Attorney, Agent, or Firm* — Andrew Wilford

(57) ABSTRACT

A safety cabinet has a box body having an open front side, a pair of doors hinged to the body and pivotal between closed positions closing the front side and open positions exposing the open front side, and a shelf slidable between an in position wholly contained in the body behind the open front side and an out position projecting forward at least partially from the open front side. A guide is provided on the shelf extending at an acute angle to the pullout direction, and an arm connected to one of the doors rides in the guide so that moving the one door into the respective open position pulls the drawer into the out position. A link connects the other door at least indirectly to the guide for pulling the other door into the respective open position on movement of the one door into the respective open position.

5 Claims, 9 Drawing Sheets

Fig. 4a
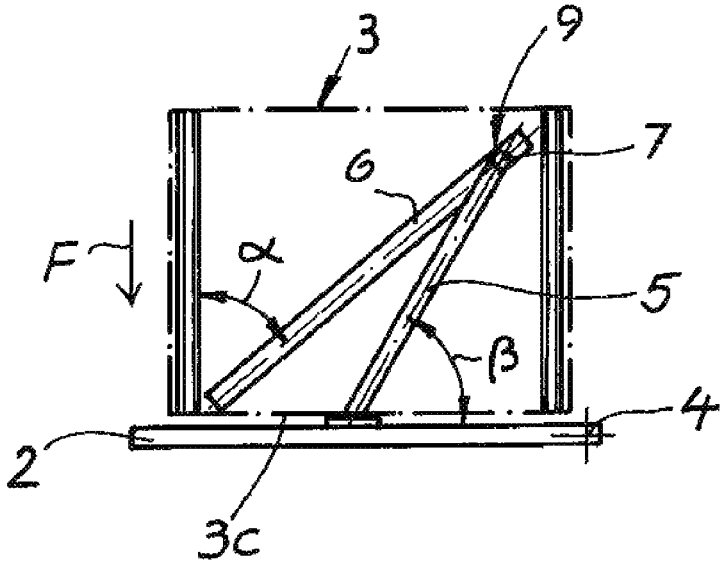
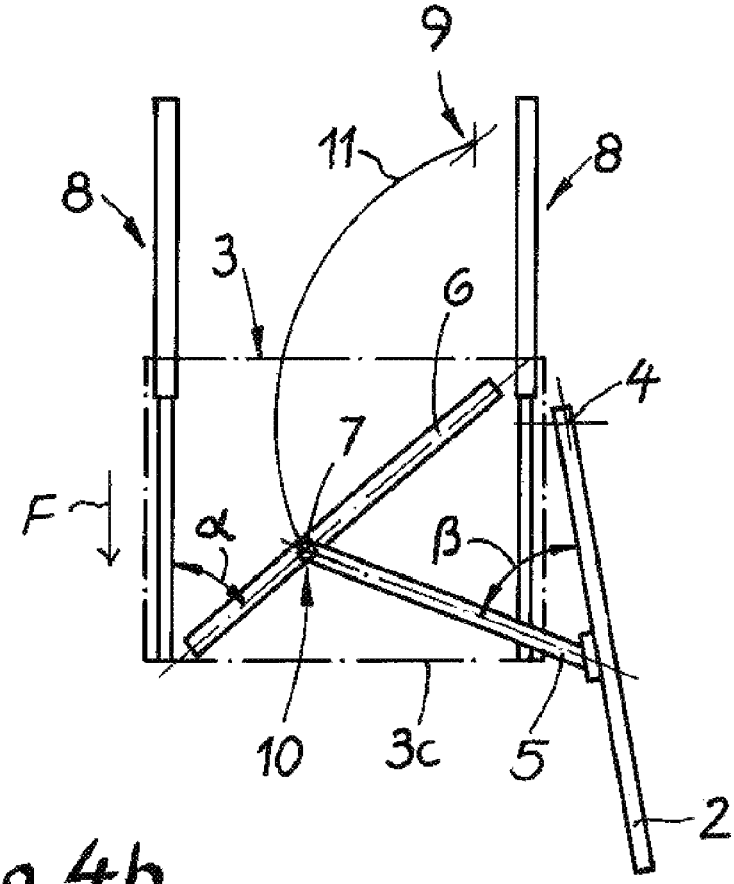
Fig. 4b

SAFETY CABINET

FIELD OF THE INVENTION

The present invention relates to a cabinet. More particularly this invention concerns a so-called safety cabinet used to store explosive or toxic chemicals.

BACKGROUND OF THE INVENTION

A safety cabinet, preferably an undercounter safety cabinet, has at least one door with an attached arm, the door being hinged to a cabinet body. At least one drawer is connected to the door such that the drawer is pulled out when the door is opened by the arm engaging a guide profile mounted on the drawer and extending at an acute angle to the pull-out direction of the drawer. Such a cabinet is described, for example in WO 1992/9020259. The core of this concept involves automatically actuating pull-out features or drawers, and an associated door. What are described, however, are exclusively solutions comprising a single door, and consequently a cabinet body of limited width.

GB 725 757 describes a cabinet inside which a carousel-type shelf is mounted on a bracket in turn carried on a slide system. The bracket is coupled to two doors through respective links.

DE 849 185 relates to a two-door phonograph record container with retractable phonograph-record rack. The phonograph-record rack rests by its front cross bar on two struts. The struts are hinged to one door each. In addition, the struts have followers that ride in a common center rail of the container bottom.

In addition, a cabinet, in particular, a safety cabinet is described in utility model DE 20 2004 004 855. These safety cabinets generally function to accommodate hazardous materials, such as, for example, chemicals or flammable liquids. As a result, they generally have autoclosing devices that, for example, ensure that the safety cabinet is reliably closed, for example, in case of fire. An autoclosing mechanism of this type that primarily utilizes an associated fusible link and a spring arrangement is also described, for example, in DE 103 05 444.

In addition, in terms of the design of their cabinet bodies and of the doors, or at least one door, these safety cabinets are designed so as to ensure a certain level of fireproofness.

Since the safety cabinets in question are filled with hazardous materials, in particular, chemicals, the insertion and removal of materials to be stocked is often a problem. According to the category-defining teaching, an operator must thus, for example, first open the door, and thus only then pull out the drawer located inside in order to position therein, for example, a bottle containing a chemical. The actuation of the door and drawer here is often performed with one hand, while the given chemical or container is held with the other hand. This is not only inconvenient but also dangerous from a safety point of view.

In fact utility model DE 20 2006 007 632 at this point already does propose a solution in which a cabinet door including a shelf unit is mounted as an assembly analogous to a carousel about a pivot set back from the cabinet door and passing through the shelf unit. In this approach, with the cabinet door open the shelf unit is swung out from the cabinet body, while when the cabinet door is closed this unit is swung into this body. This has proven successful. Up until now, however, no satisfying solutions have existed for drawers.

OBJECTS OF THE INVENTION

It is therefore an object of the present invention to provide an improved safety cabinet.

Another object is the provision of such an improved safety cabinet that overcomes the above-given disadvantages, in particular where handling is simplified, and, in particular, danger is reduced.

SUMMARY OF THE INVENTION

A safety cabinet has according to the invention a box-shaped hollow body having an open front side, a pair of doors hinged to the body and pivotal between closed positions fitting against the body and closing the front side and open positions pivoted out from the body and exposing the open front side, and a shelf slidable in a direction between an in position wholly contained in the body behind the open front side and an out position projecting forward at least partially from the open front side. A guide is provided on the shelf extending at an acute angle to the direction, and an arm connected to one of the doors rides in the guide so that moving the one door into the respective open position pulls the drawer into the out position.

A link connects the other door at least indirectly to the guide for pulling the other door into the respective open position on movement of the one door into the respective open position.

Usually the drawer is also pushed back in by the one door. In additional, however, it can also in principle close independently. Consequently, what is achieved according to the invention is that the drawer automatically is pulled out when the one door is opened, and is inserted during the closing process. This simplifies handling while allowing the drawer to be loaded conveniently from the front and/or the side.

In particular the invention proposes for this purpose that the door be equipped with an arm that engages the guide profile on the drawer. Typically, the arm is attached to the inside of the door. This can be done by a hinge allowing the arm to change its angle relative to the door.

Generally according to the invention the arm forms a fixed predefined angle with the door. In other words, it is fixed to the door in a fixed position. Usually, the arm is attached to the inner face of the door, forming with the plane of the door an acute angle ranging between approximately 30° and approximately 80°, preferably between 40° and 70°. In addition, the arm is attached to the door facing inward relative to the inside of the door.

Another approach that has proven successful is to provide the arm below the drawer. In other words, the arm engages the drawer from below since it is below the guide plane of the drawer. This guide plane of the drawer is defined by at least one slide assembly on which the drawer is pulled out and pushed back in. Usually, two drawer slide assemblies are provided that each engage one side of the drawer and the respective confronting inner face of the side wall of the cabinet body. These slide assemblies telescope to carry the drawer in the out position wholly outside the cabinet, making them so-called full-extension slides. The arm is disposed below this guide plane defined by these drawer slide assemblies so that the arm does not collide with the drawer slide assemblies when the drawer is pulled out and pushed back in.

The guide profile on the drawer is generally designed as a guide rail to engage the arm. A guide pin engages up into the inverted U-section guide rail, or multiple guide pins engage this rail. The guide pin(s) is/are attached to the arm.

The guide profile extends on the drawer at an acute angle relative to the pull-out direction of the drawer. Typically, the pull-out direction of the drawer coincides with the telescoping direction of the drawer slide assemblies. Relative to this telescoping direction or pull-out direction of the drawer, the guide profile forms an acute angle. Usually, an acute angle is set here that ranges between 30° and 80°, preferably between 40° and 70°.

In addition, the guide profile or rail is generally attached to the bottom of the drawer. By this means, the arm attached to the door is below the guide plane and consequently below the guide rails, and thus also below the drawer bottom so it can interact in a trouble-free manner with the guide profile or rail. To this end, the guide pin that is projects up from the arm engages the guide profile or rail above it.

When the door is moved, the arm slides together with its guide pin along the guide profile. The design is generally effected here such that this guide pin completes a part-circular arc centered on the pivot axis of the door. When moving along the circular arc about the door axis, the guide pin slides along the guide profile from a start position to an end position. When the door is opened and thus the drawer is also pulled out, the start position here corresponds to the guide pin's being remote from the front side of the drawer. Conversely, the end position of the guide pin in the guide profile corresponds with a close placement of the guide pin to the drawer front side. In other words, the guide profile, preferably attached to the drawer bottom, has such an acute position relative to the pull-out direction of the drawer that the start position of the guide pin within the guide profile is at a further distance from the front side of the drawer than the end position. During movement of the guide pin from the start position to the end position when the door is opened, a force is exerted in the pullout direction on the drawer due to the circular-arc motion about the door axis exerted simultaneously by the guide pin, and specifically in such a manner that in the described process the drawer is pulled out (and pushed back in on closing) automatically.

As a result, when operating the safety cabinet according to the invention it is sufficient to simply open the door. This is due to the fact that by this opening process the extended drawer becomes available simultaneously and can be used immediately. When the door is closed, the drawer automatically follows this closing motion and also transitions to its closed position.

A point that should be emphasized is that of course the door within the scope of the invention also relates, or can relate, to a folding door. The critical fact is that the door can be pivoted about the door axis relative to the cabinet body and is hinged to this body in the door axis. In addition, it is of course obvious within the scope of the invention that not only one door can be present in the cabinet body, but, for example, also two or more doors. Furthermore, multiple drawers can obviously also be automatically pulled out and pushed back in by means of the one door. In all cases, the handling of the cabinet according to the invention is enormously enhanced while accidents are significantly reduced. In particular, there is practically no longer any danger that, for example, a flammable liquid or other chemical will be dropped unintentionally when the cabinet is opened.

These advantages and effects are also observed when in addition to the first door the additional second door is connected to the drawer. In other words, both the first door and the second door are connected to the drawer. As a result, it is possible to use a drawer that fills the cabinet body across nearly its entire width. The size of the cabinet body or its width thus nearly match the width of the cabinet body, and thus the combined width of the two doors.

The design is advantageously chosen so that the first door and the second door are connected to the drawer in such a way that, when a door is opened or closed, both the drawer and also the other door are likewise opened and closed. With the cabinet according to the invention, one hand of one operator is thus still sufficient for automatically opening and closing both doors and also the drawer. The operator's other hand is thus available to handle the hazardous materials.

All of this functions successfully with a drawer of relatively large dimension, that is, one that fills out the width of a cabinet body that is equipped with two (or even more) doors. In an advantageous embodiment, this cabinet, in particular, a safety cabinet, is an undercounter cabinet for which the simple handling described is of particular importance.

This is true since this type of undercounter cabinet is typically placed underneath a laboratory bench or similar table and is also designed as a safety cabinet, thus constituting an undercounter safety cabinet. What is critical precisely for this type of undercounter cabinet or undercounter safety cabinet is that the simplest and most hazard-free handling possible be ensured along with, at the same time, a large capacity. The invention achieves this by the described ability to be able to simultaneously open and close both doors with single-handed operation, and also pull out and insert the drawer connected thereto. Overall, this is achieved in a simple and trouble-free manner whereby the potential danger is low since one hand of the operator continues to remain available for handling, for example, the chemicals, bottles, or containers.

In order to implement the described inventive measures in detail, the first door is equipped with the attached arm already described. This arm engages the guide profile on the drawer. The guide profile is usually located on the bottom of the drawer. The guide profile on the drawer is generally designed as a guide rail. One guide pin or multiple guide pins can engage the guide rail. The guide pin(s) may be attached to the arm.

The second door is connected to the arm of the first door. For purposes of connecting the second door to the arm of the first door, the invention proposes a connecting rod or similar link. The connecting rod here can preferably engage the guide pin. This guide pin is located on the arm and engages the guide rail below the drawer.

As a result, both the arm and the link are below the guide plane of the drawer. In other words, the region of the drawer and the space proceeding from it above a drawer bottom are explicitly clear of any guides, links, etc., and thus can be utilized in their entirety for storing hazardous materials.

Generally, the arm is connected to the door at a fixed predefined angle. On the other hand, the link is pivoted on both the second door and the arm. The arm is typically located on the inside of the first door. The connection here can also be implemented by an articulated joint, thereby enabling the arm to change its angle relative to the first door. Usually this is not the case, however, since the arm forms a fixed predefined angle with the first door.

In this connection, the arm has an attachment on the inside of the first door, specifically at an acute angle ranging between 30° and 80°, preferably between 40° and 70°. In addition, the arm projects inward from the inside of the respective door.

The guide profile for the guide pin on the arm of the first door generally extends on the drawer at an acute angle relative to the pull-out direction for the drawer. Usually, the pull-out direction of the drawer coincides with the telescoping direction of the drawer guide rail or of the, usually, two drawers. The guide profile is at an acute angle relative to the telescoping direction or pull-out direction of the drawer. An angle is usually set here that ranges between 30° and 80°.

Since the guide profile or the guide rail and also the link are connected to the drawer bottom below this bottom, a trouble-free interaction can be established for both the arm and the link with the guide profile or the guide rail, that is, through the common guide pin that extends into the guide rail. In other words, the guide pin that projects up from the arm and to which the link is also connected, engages the guide profile above it.

Whenever the door is moved, the arm slides together with its guide pin along the guide profile. At the same time during this process, a corresponding force is exerted on the second door through the link that is also connected to the guide pin. The design is generally selected here so that the guide pin follows a part-circular arc relative to a door axis of the first door and also of the second door. In traversing this part-circular arc, the guide pin slides along the guide profile, specifically from a start position to an end position. When the two doors are opened and thus the drawer is pulled out simultaneously, the start position here corresponds with the guide pin being remote from the front side of the drawer. Conversely, the end position of the guide pin within the guide profile corresponds to a position close to the drawer front-side.

A point that should be emphasized is that of course the door within the scope of the invention also relates, or can relate, to a folding door. The critical fact is that the particular door can be pivoted about the door axis relative to the cabinet body and is hinged to this body in the door axis. In addition, even multiple stacked drawers can obviously also be automatically pulled out and pushed back in by the two doors. In all cases, the handling of the cabinet or safety cabinet according to the invention is enormously enhanced, and in fact while simultaneously providing an increased volumetric capacity for the drawer used. As a result, the frequency of accidents is significantly reduced. In particular, there is practically no danger that, for example, a flammable liquid or also a chemical will be dropped unintentionally when the cabinet is opened.

In another advantageous embodiment, the cabinet or safety cabinet according to the invention has a autoclosing mechanism as known per se. The autoclosing mechanism ensures that when triggered, for example during a fire, both doors including the drawer are closed. Obviously, the autoclosing mechanism can also be triggered when a contact element or the like is actuated. Generally, however, the autoclosing mechanism ensures that the two doors and the drawer are closed in the presence of increased temperatures, that is in case of fire, with the result that the flammable liquids or hazardous materials inside the cabinet are generally protected from these increased temperatures.

The autoclosing mechanism has a prestressed spring that when triggered acts on a stop interacting with one of the two doors. The spring here is advantageously mounted on the rear wall of the cabinet body, specifically inside the cabinet body.

As a result, the available rebound space is optimally utilized since the spring is usually located at the top of the cabinet body so that practically no space is lost for accommodating hazardous materials.

A successful approach is to design the stop as a ring. This enables the stop to advantageously interact with the closing rod that is connected to one or both of the doors. The stop generally moves within a guide. The stop here normally occupies a fixed position. This is ensured by a mount that holds the spring of the autoclosing mechanism in its prestressed position. This mount is broken only when the system is triggered, thereby ensuring that the stop is released from the mount. As a result of this action, the previously prestressed spring can now release. During this process, the released spring carries the stop together with it, which stop thus assumes its closing position.

Since the stop both moves within the guide and also interacts with the closing rod, the door connected to the closing rod is closed. Since the one door is connected to the drawer and the other door, this situation operates the other door and the drawer also. In other words, the actuated mount and the releasing spring in combined fashion ensure that both doors and the drawer are closed together and automatically when the system is triggered. As a result, any hazardous material in the drawer inside the safety cabinet is optimally protected.

BRIEF DESCRIPTION OF THE DRAWING

The above and other objects, features, and advantages will become more readily apparent from the following description, reference being made to the accompanying drawing in which:

FIGS. 4*a* and 4*b* are small-scale schematic top views illustrating the door mechanism in the closed and fully open positions;

SPECIFIC DESCRIPTION

Figure 1:
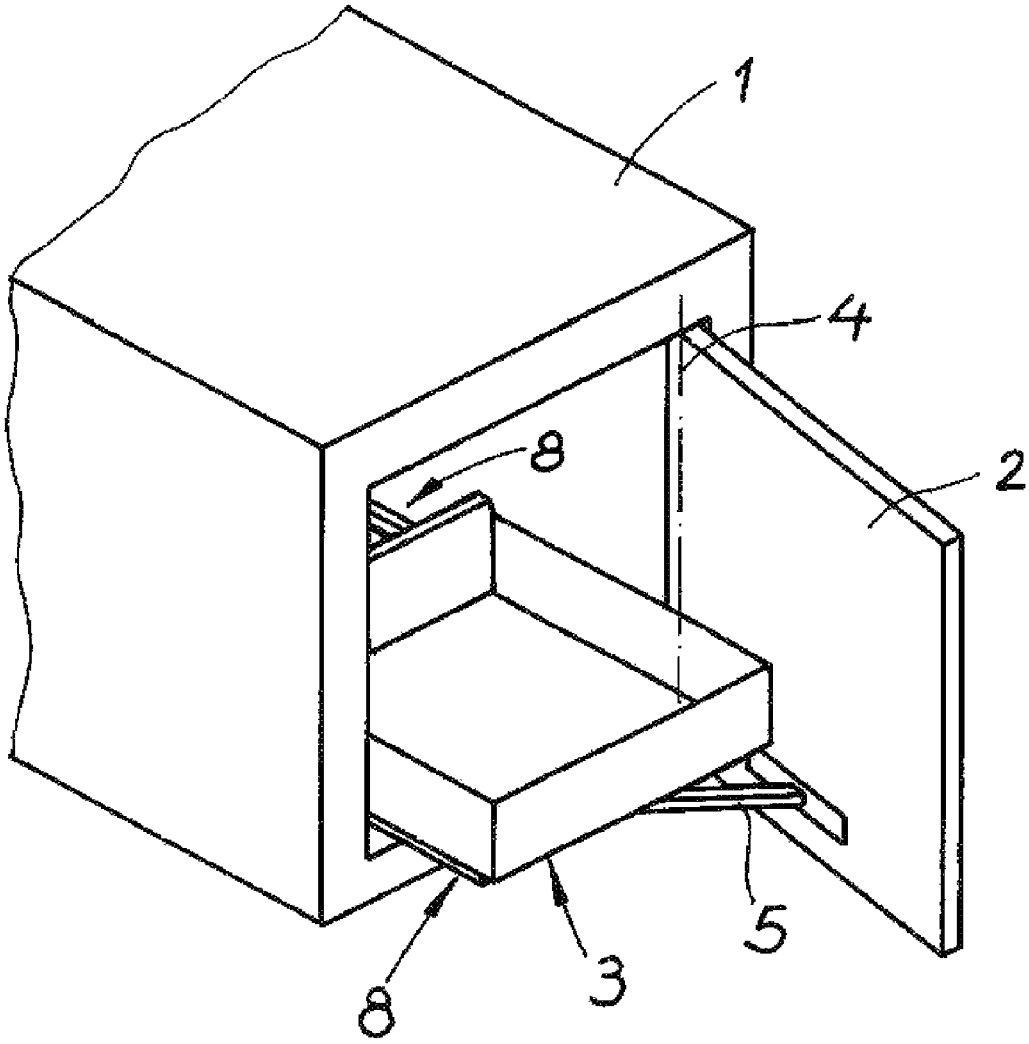
FIG. 1 is a small-scale perspective view from the front, above and to the side, of a safety cabinet with its door partially open.
Figure 2:
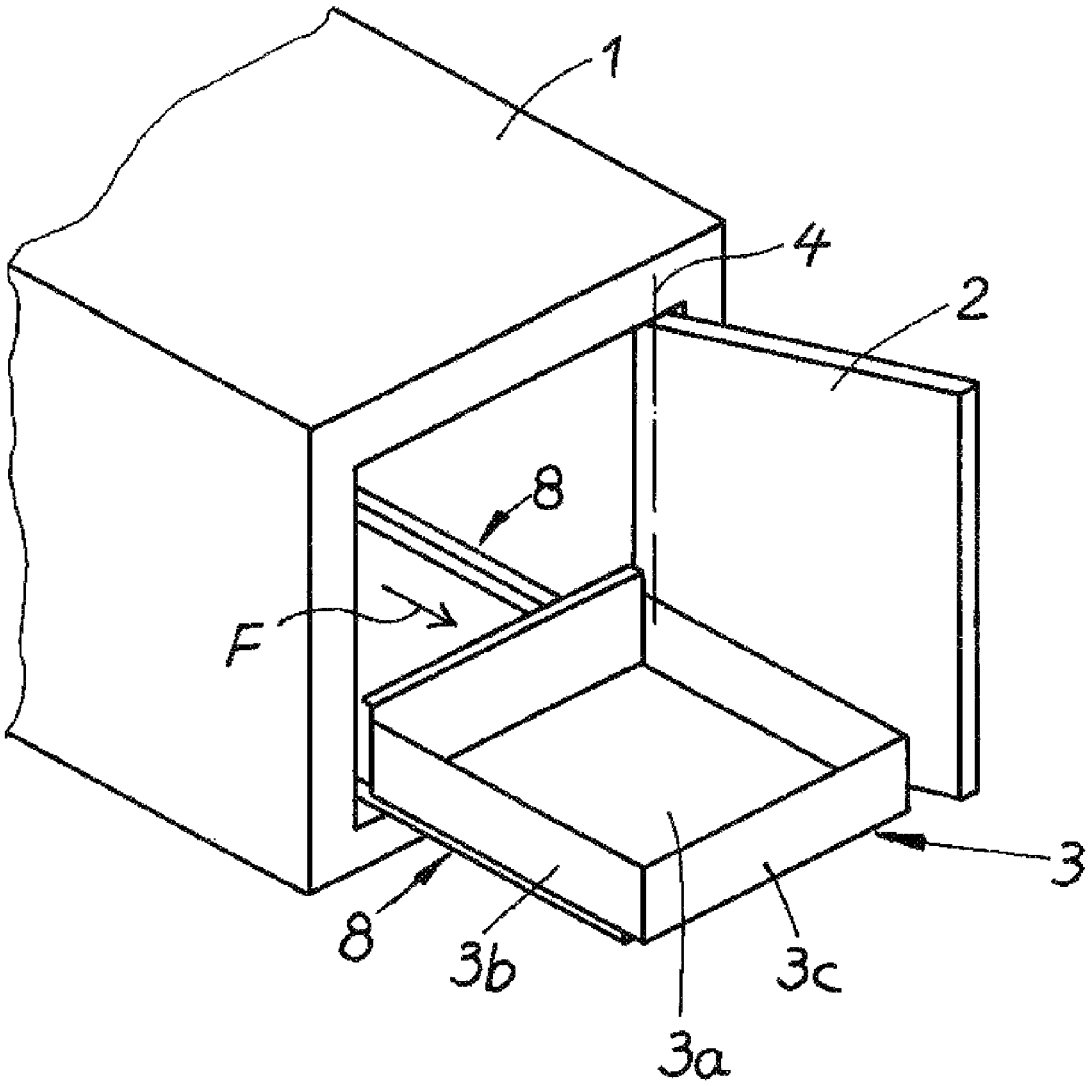
FIG. 2 is a view like FIG. 1 but with the door fully open.
Figure 3:
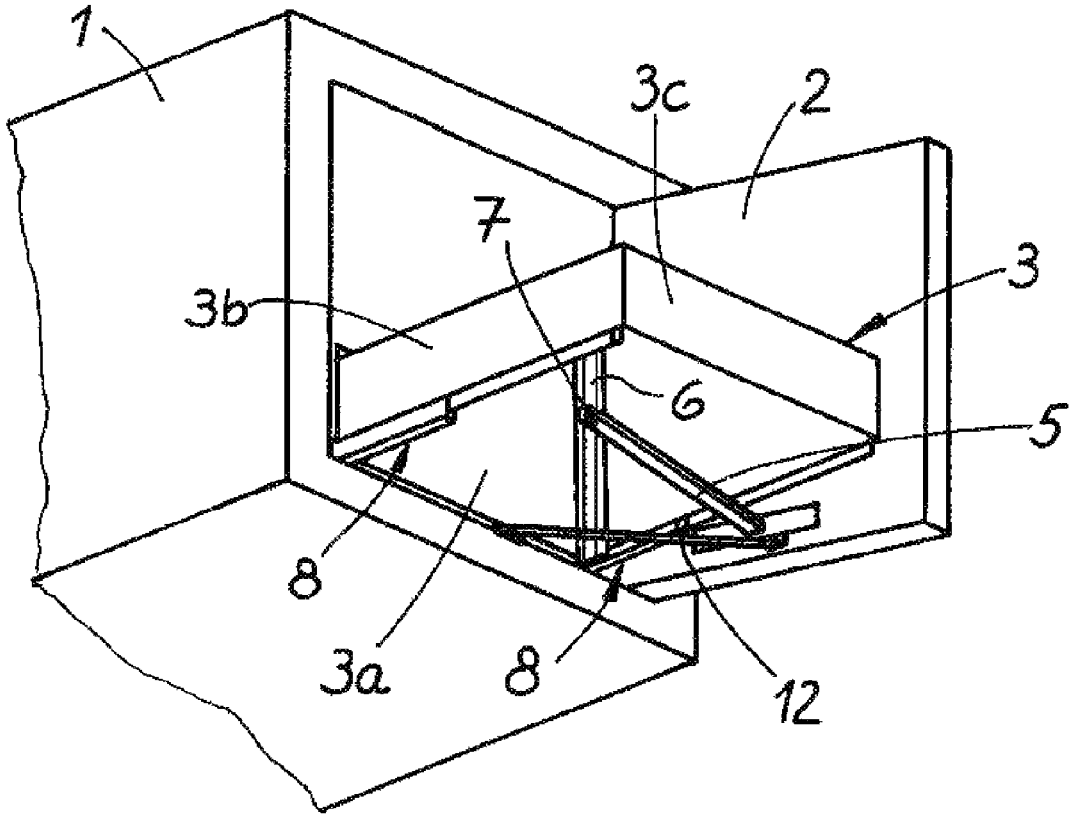
FIG. 3 is a view of the cabinet as in FIG. 2, but from below.
Figure 5:
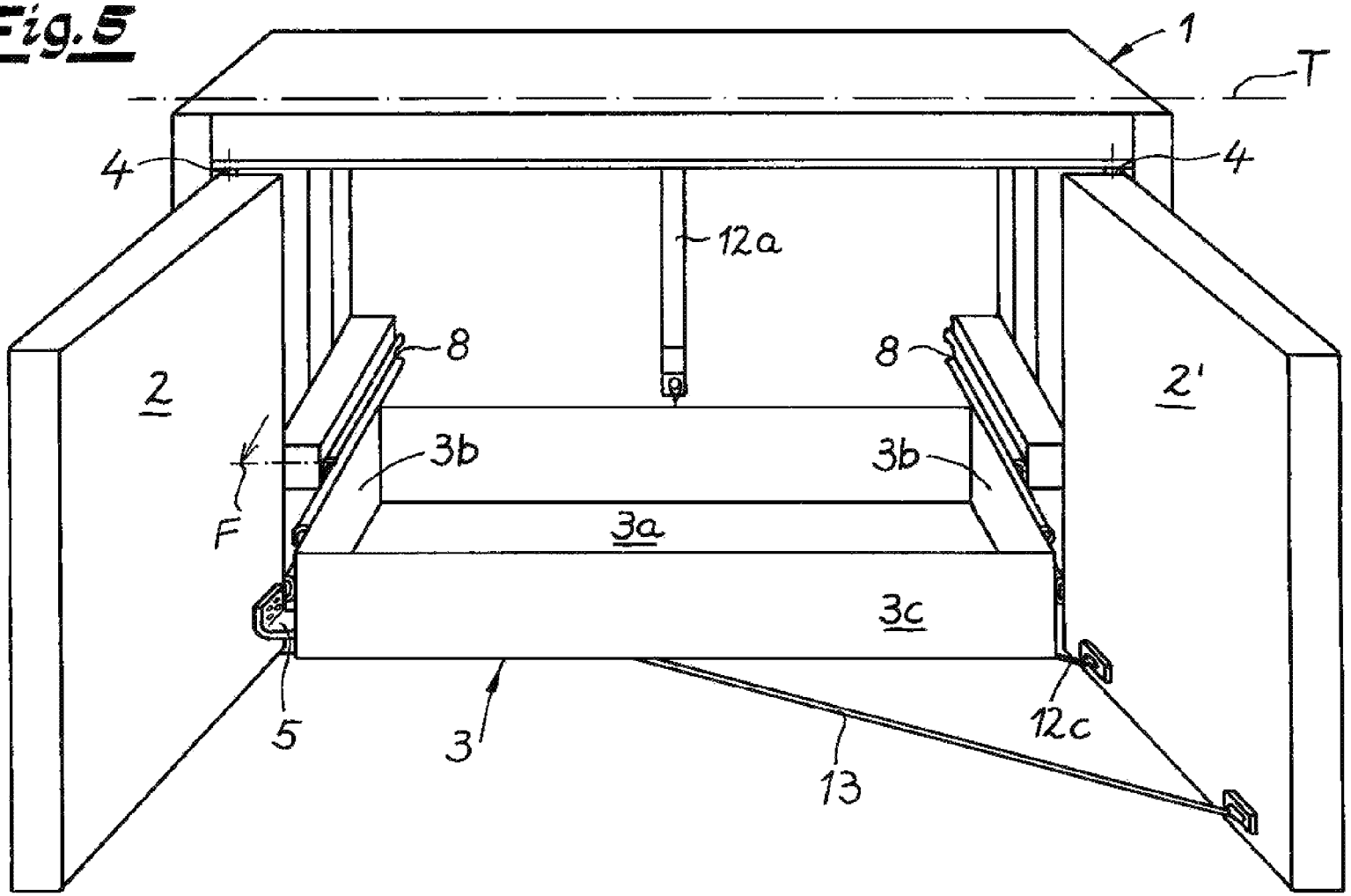
FIG. 5 is a perspective front view of a two-door cabinet in the fully open position.

As seen in FIGS. 1-3 a safety cabinet used to store flammable liquids and gases has a sturdy box-like body with an open front side and a rectangular rigid door 2 pivoted at one edge of the front side about a vertical axis 4. A shelf or drawer 3 is supported on full-extension slides 8 on side walls of the body 1 and on side walls 3*b* of the drawer 3 for movement in a direction F between an unillustrated in position wholly contained in the body 1 and an out position wholly projecting therefrom as shown in FIG. 2. FIG. 1 shows the shelf/drawer 3 partially extended.

In order to make it easy to take materials out of and load them into the cabinet, the door 2 according to the invention is connected to the drawer 3. Thus the drawer 3 is automatically pulled out when door 2 is opened, then automatically pushed back in when it is closed. To this end, the door 2 has as shown in FIGS. 4*a* and 4*b* a mechanism or linkage 5-7 that automatically pulls the drawer 3 out when the door 2 is opened, and automatically pushes it back in when the door 2 is closed.

Specifically a rigid arm or link 5 has an outer end secured generally centrally in the middle of the bottom edge of the door 2 and an inner end having a pin or roller 7 riding in an angled guide track 6 on the bottom wall or floor 3*a* of the drawer 3. The arm 5 and track 6 are below the plane of the slide assemblies 8 and the pin 7 projects up from the arm 5 into the track 6.

As shown in FIGS. 3, 4*a*, and 4*b* the guide rail 6 is attached to the drawer bottom 3*a* at an acute angle $\alpha$ relative to the drawer pull-out direction F. Here the angle $\alpha$ ranges between 30° and 80°. The design here is selected so that a start position 9 (FIG. 4*a*) of the guide pin 7 in the rail 6 when the door 2 is closed is at a considerable spacing from a front side 3*c* of the drawer 3. Conversely, an end position 10 (FIG. 4*b*) of the guide pin 7 when the door 2 is open is relatively close to this front side 3*c*. The pin 7 thus travels between the positions 9 and 10 to pull out the drawer 3, and oppositely to push it back in.

Since the arm 5 forms with the door 2 a fixed and predefined angle β that lies between approximately 30° and 80° (see FIG. 1), the guide pin 7 moves along a circular arc 11 relative to the door axis 4, as indicated in FIGS. 4*a* and 4*b*, when the door 2 is opened and closed. Since the arm 5 is fixed to the door 2, the guide pin 7 moves only along this one circular arc 11. When the door 2 is opened, the guide pin 7 now moves from its start position 9 to the end position 10. During this process and thus its simultaneous approach toward the front side 3*c* of the drawer 3 within the guide rail 6, the drawer 3 is simultaneously acted upon by an axial force vector in the pull-out direction F. As a result, the drawer 3 is automatically opened with the door 2 when the door 2 is opened. The reverse process is completed when the door 2 is closed.

FIG. 3 illustrates yet another rod 12 in the form of a component of an autoclosing mechanism. In fact, the rod 12 acts upon a prestressed spring that engages the rod 12, and consequently closes the door 2 and pulls in the drawer 3 attached thereto, once a predetermined temperature has been reached and an associated fusible link melts. The autoclosing mechanism here may operate on the principle described in abovecited DE 103 05 444 or DE 20 2004 004 855.

FIGS. 5 through 8 show a cabinet according to the invention that in this case is designed as a safety cabinet and again functions to store flammable liquids and gases. Here the body 1 carries, in addition to the first door 2, a second door 2', pivoted at another vertical axis 4 on the other side of the front of the body 1. This cabinet is an undercounter safety cabinet that may be used below a tabletop T shown here only schematically.

In order to make it easy to take materials out of and load them into the safety cabinet, according to the invention both the first door 2 and the second door 2' are attached to the drawer 3. In other words, the additional second door 2' is connected to the drawer 3 just like the first door 2. As a result, the drawer 3 is automatically pulled out when either door 2 or 2' is opened, and the drawer 3 is automatically pushed back in when either door 2 or 2' is closed. Similarly, the first door 2 and second door 2' are connected to the drawer 3 such that when one of the two doors 2 or 2' is opened or closed the other door 2 or 2' is also opened and closed, while the drawer 3 is slid out or in.

Figure 6:
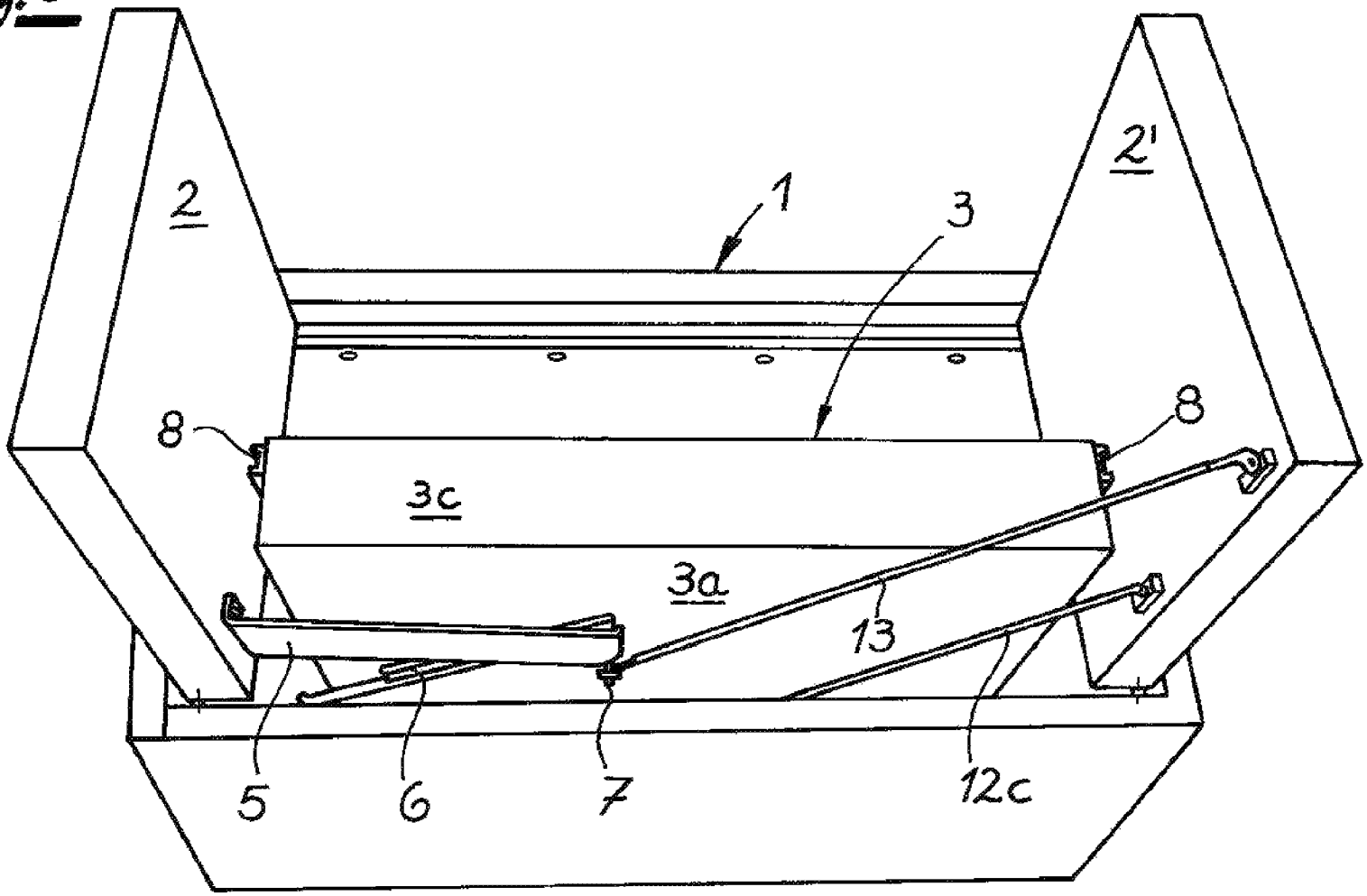
FIG. 6 is a bottom view of the two-door cabinet in the fully open position of FIG. 5.

In particular the first door 2 is equipped with the attached arm 5 that engages the guide profile 6 on the drawer 3. The arm 5 is attached on the inside to first door 2, but it could just as well be located on the inside of second door 2'. Regardless, the arm 5 engages the guide profile 6 that is in turn connected to the drawer 3. In fact, the guide profile or guide rail 6 is located on the bottom 3*a* of the drawer, as shown in FIG. 6.

In order to engage the guide profile or rail 6, the arm 5 is equipped with the guide pin 7. This guide pin 7 projects from the arm 5 toward the drawer bottom 3*a*. This is explained by the fact that arm 5 is disposed below the drawer 3. The drawer is supported by the two drawer slides 8 that are attached on the inside of the cabinet body 1 and on the sides 3*b* of the drawer 3. These slides 8 telescope when the drawer 3 is pulled out and pushed in. In addition, a rod or link 13 connects the second door 2' to the arm 5 of the first door 2 and is located below the drawer 3. In fact, this link 13 advantageously engages the guide pin 7 provided on the arm 5.

As a result, the drawer 3 is attached on one side to the first door 2 by the arm 5 that engages with the guide pin 7 in the guide rail 6 on the drawer bottom 3*a* of the drawer 3. On the other side, the drawer 3 and the first door 2 are connected with the second door 2' by the link 13. This is because the link 13 is coupled at one end to the guide pin 7 and thus to the drawer 3 as well as to the first door 2, and is attached at the other end to the second door 2'.

Figure 7A:
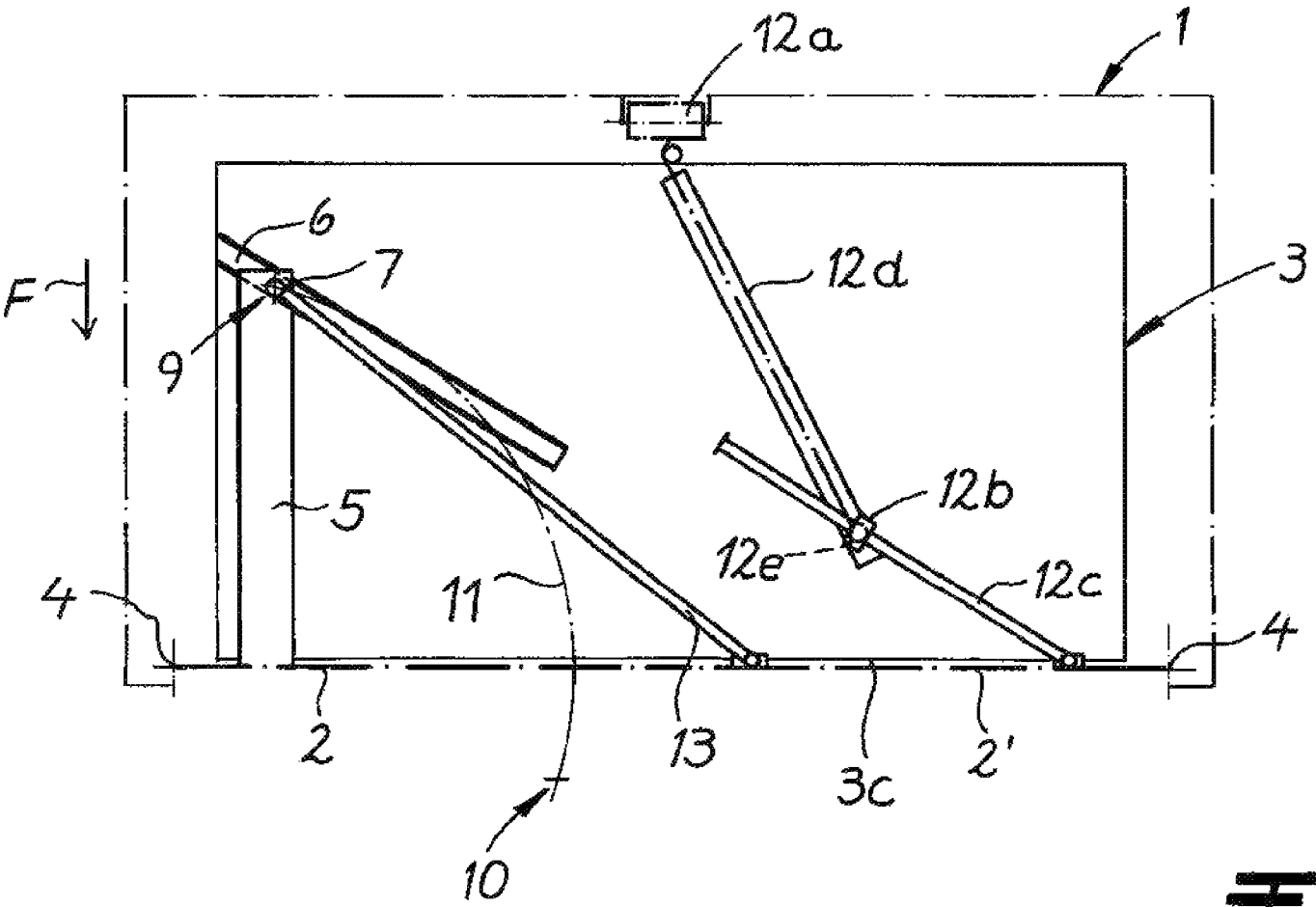
FIGS. 7*a* and 7*b* are small-scale schematic top views illustrating the door mechanism of the two-door cabinet in the closed and fully open positions.
Figure 7B:
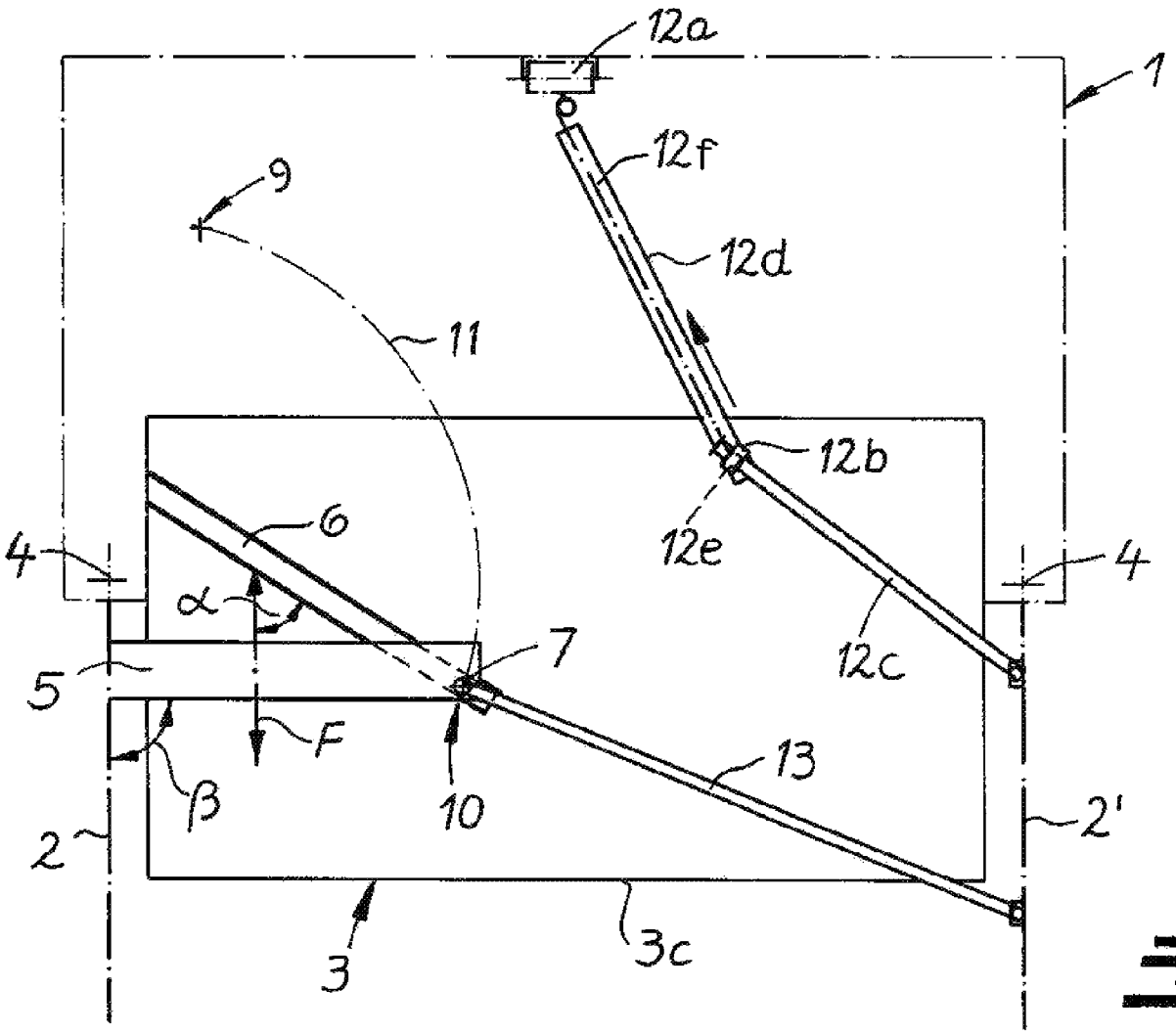
Figure 8:
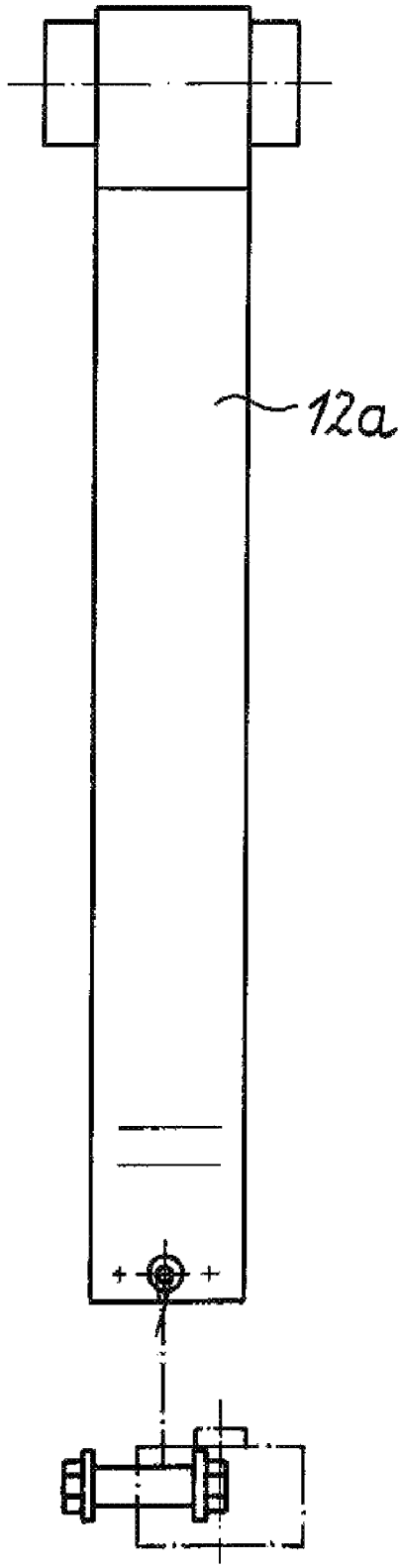
FIG. 8 is a larger-scale view of the spring of the door mechanisms.

FIGS. 7*a* and 7*b* show that the guide profile or rail 6 is attached to the drawer bottom 3*a* and extends at an acute angle α to the pull-out direction F. The angle α lies between approximately 30° and 80°. In contrast, the link 13 forms an articulated coupling in that it is pivoted about a vertical axis on the guide pin 7 and on the second door 2' offset from its pivot axis 4. Thus while the arm 5 forms a fixed predefined angle β here of 90° with the first door 2, the link 13 is pivoted on both the second door 2' and on the arm 5 of the first door 2.

FIGS. 7*a* and 7*b* clearly show that the guide pin 7 again moves along the circular arc 11 centered on the door axis 4 of the first door 2 when the two doors 2 and 2' are opened and closed. Analogously, the guide pin 7 also describes a circular arc relative to the axis 4 of the second door 2'. In any case, when the two doors 2 are 2' are opened the guide pin 7 moves from its start position 9 as indicated in FIG. 7*a* to the end position 10 of FIG. 7*b*.

During this process and consequently during the simultaneous approach of guide pin 7 toward the front side 3*c* of the drawer 3 within the guide rail 6, the drawer 3 is simultaneously acted upon by an axial force vector in the pull-out direction F. As a result, the drawer 3 is automatically opened together when either of the two doors 2 or 2' is opened.

The reverse process is completed when either of the two doors 2 or 2' is closed, that is the drawer 3 is closed as well. Based on this specific design, the drawer 3 is able to fill the cabinet body 1 across nearly its entire width. What can be employed is thus an especially wide drawer 3 that, as it were, covers two doors 2 and 2'.

Finally, FIGS. 5 through 8 show an autoclosing mechanism. In terms of its fundamental construction, this mechanism first of all has a prestressed spring 12*a* that acts via a cable 12*f* on a ring stop 12*b* that interacts with one or both of doors 2 and 2' when the system is triggered. The prestressed spring 12*a* is mounted on an inside face of a rear wall of the cabinet body 1. The stop 12*b* is a ring through which passes a rod 12*c* and that can slide along a guide bar 12*d*. This ring stop 12*b* is normally fixed to the front or outer end of the guide bar 12*d* by a fusible mount 12*e*. As shown in the illustrated embodiment but not limited to this, the rod 12*c* is pivoted on the second door 2'.

In the normal rest position shown in FIGS. 5 through 8, the stop ring 12*b* is fixed in place by means of the fusible mount 12*e*. Only when the system is triggered, for example in case of a fire, is the stop 12*b* released by the mount 12*e* so the spring 12*a* can pull it back by the cable 12*f* along the guide 12*d*. In this case, the mount 12*e* is separated because at least part of it melts or softens. As soon as a predetermined temperature has been exceeded, the fusible part melts and the ring stop 12*b* is free to slide along the rail 12*f*, and the prestressed spring 12*a* is pulled back by the tension in the spring 12*a*. The stop 12*b* moves along the guide 12*d* as shown by an arrow in FIG. 7*b*.

Since the stop 12*b* surrounds the rod 12*c*, when the enlarged flanged end of this rod 12*c* engages the stop 12*b*, the rod 12*c* itself is also pulled back. As a result, the second door 2' attached to the closing rod 12*c* is pulled closed. Along with it, of course, the first door 2 and the drawer 3 are pulled back in.

In other words, when the autoclosing system is triggered, it ensures that both the doors 2 and 2' are closed and the drawer 3 connected thereto is pulled back in. Any hazardous materials located on the drawer 3 are thus moved inside the cabinet body 1, which is then closed to the exterior. As a result, the hazardous materials are protected, for example, against the effects of fire.

We claim:

1. A safety cabinet comprising:

a body having an open front side;

first and second doors hinged to the body and pivotal thereon about respective parallel first and second axes between closed positions fitting against the body and closing the front side and open positions pivoted out from the body and exposing the open front side;

a shelf slidable in a direction between an in position wholly contained in the body behind the open front side and an out position projecting forward at least partially from the open front side;

a guide rail fixed underneath the shelf and extending at an acute angle to the direction;

an arm fixed to and defining a predetermined fixed angle from the first door and having an inner end provided underneath the shelf with a follower pin riding in the guide rail such that pivoting the first door about the first axis into the respective open position pulls the shelf into the out position and pivoting the first door about the first axis into the respective closed position pushes the shelf into the in position while moving the follower pin on a circular arc centered on the first axis, the follower pin being spaced in the closed position of the first door farther from a front side of the shelf than in the open position of the first door; and a rigid link pivoted on the second door and on the inner end of the arm for movement of both of the doors into the respective open positions on movement of either of the doors into the respective open position and for pulling both of the doors into the respective closed positions on movement of the either of the doors into the respective closed position with movement of the shelf from the out position to the in position on movement of either of the doors to the closed position and travel of the pin along the arc.

2. The safety cabinet defined in claim 1 wherein the shelf is a drawer having a floor to a lower face of which the guide rail is fixed.

3. The safety cabinet defined in claim 1 wherein the follower pin moves along the guide rail on movement of either of the doors between the respective open and closed positions.

4. The safety cabinet defined in claim 1 wherein the link has an inner end attached to the arm at the follower pin.

5. The safety cabinet defined in claim 4 wherein the link has an outer end pivoted on the second door.

* * * * *